US006527683B2

(12) United States Patent
Tolles

(10) Patent No.: US 6,527,683 B2
(45) Date of Patent: Mar. 4, 2003

(54) DUAL ADJUSTABLE PULLEY WEIGHT APPARATUS

(75) Inventor: Bret A. Tolles, Cayucos, CA (US)

(73) Assignee: Brunswick Corporation, Lake Forest, IL (US)

( * ) Notice: Subject to any disclaimer, the term of this patent is extended or adjusted under 35 U.S.C. 154(b) by 149 days.

(21) Appl. No.: 09/784,906

(22) Filed: Feb. 15, 2001

(65) Prior Publication Data

US 2001/0034290 A1 Oct. 25, 2001

Related U.S. Application Data

(60) Provisional application No. 60/183,084, filed on Feb. 16, 2000.

(51) Int. Cl.[7] ..... A63B 21/062

(52) U.S. Cl. ..... 482/99; 482/103; 482/908

(58) Field of Search ..... 482/98, 99, 100, 482/101, 102, 103, 138, 908

(56) References Cited

U.S. PATENT DOCUMENTS

| | | | | |
|---|---|---|---|---|
| 4,634,118 A | | 1/1987 | Jensen | |
| 4,674,485 A | | 6/1987 | Swanson | |
| 4,775,146 A | | 10/1988 | Stankovic | |
| 4,898,381 A | * | 2/1990 | Gordon | 482/908 |
| 5,158,516 A | | 10/1992 | Johnson | |
| 5,211,614 A | | 5/1993 | Henes | |
| 5,221,245 A | * | 6/1993 | Yeh | 482/138 |
| 5,230,680 A | | 7/1993 | Wu | |
| 5,242,347 A | | 9/1993 | Keeton | |
| 5,256,122 A | * | 10/1993 | Deden | 482/99 |
| 5,518,477 A | | 5/1996 | Simonson | |
| 5,605,523 A | * | 2/1997 | Ish et al. | 482/99 |
| 5,931,767 A | | 8/1999 | Morales | |
| 5,951,444 A | | 9/1999 | Webber | |
| 5,951,449 A | | 9/1999 | Oppriecht | |
| 5,961,427 A | | 10/1999 | Habing et al. | |
| 5,989,164 A | | 11/1999 | Kullman et al. | |

* cited by examiner

*Primary Examiner*—Stephen R. Crow
*Assistant Examiner*—Quang D Thanh
(74) *Attorney, Agent, or Firm*—Mayer, Brown, Rowe & Maw

(57) ABSTRACT

An exercise machine having a frame, weight stack, pulleys, and cables and incorporating a dual adjustable pulley system is disclosed. The weight stack is slidably connected to the frame. A primary moveable pulley system is engaged with the weight stack by way of a primary cable. The primary cable has a handle connected to its first end and its second end is fixed with respect to an exercise movement. A series of directional pulleys are also engaged with the primary cable. The directional pulleys are positioned on the frame to allow for an exerciser to perform multiple exercises employing the weight stack. A secondary moveable pulley system is engaged with the primary moveable pulley system. The secondary moveable pulley system can be selectively engaged with the weight stack using a releasable coupler. A secondary cable is functionally engaged with the secondary moveable pulley system and a number of directional pulleys. The secondary cable has a first end that is fixed to a floating pulley. The floating pulley is functionally engaged with the primary cable. The secondary cable has second end that selectively engages the weight stack. The relationship between the primary moveable pulley system and the secondary moveable pulley system is such that when the handle is moved in an exercise motion, the weight stack provides resistance to the exercise motion.

20 Claims, 1 Drawing Sheet

DUAL ADJUSTABLE PULLEY WEIGHT APPARATUS

The application claims the benefit of Provisional Application Serial No. 60/183,084, filed Feb. 16, 2000.

BACKGROUND

1. Field of the Invention

The present invention relates generally to exercise machines and more particularly to an exercise machine that has a pulley arrangement that allows for varying the mechanical advantage provided by traditional pulley exercise machines.

2. Related Art

Various exercise machines for strength training are well known in the art including machines that utilize a weight stack and pulley system to provide resistance to an exercise movement. A typical exercise machine has a frame, a load or some means to provide resistance mounted on the frame, and multiple exercise outlets functionally connected to the load. Pulleys and cables are the most common method used to functionally connect the load to the exercise outlets. Pulley and cable exercise machines provide mechanical advantages to the exerciser using the machine. The mechanical advantage can be positive, negative or neutral. The mechanical advantages are a result of understood principals of physics.

A typical cable and pulley set up employs a first cable connected at a first end to a load and at a second end to a first pulley. A second cable is connected at a first end to a first exercise station. A second end of the second cable engages a second pulley, then engages the first pulley, then a third pulley before finally being fixed to the frame. This pulley configuration allows the exerciser to provide a force of 50% of the load to lift the load. The mechanical advantage in the above pulley arrangement is in the ratio of 1 to 2. The addition or subtraction of pulleys alters the mechanical advantage realized by the exerciser.

Many exercise machines are designed for use in areas that are either multipurpose or smaller than a traditional gymnasium, for example, a home or apartment. With these area restrictions it has become increasingly more important to conserve space by reducing the size of the exercise machines as well as incorporating multiple functions into one machine. Many of the prior inventions, for example, provide an exercise machine that allows an exerciser to perform different exercise movements using a single weight stack. This arrangement of multiple exercise outlets and a single weight resistance module is accomplished by providing multiple cable and pulley systems that are operable independent of one another. Previous pulley arrangements incorporate a fixed mechanical advantage which is predetermined by the number and position of the pulleys in the system.

The exerciser, therefore, is limited to changing resistance levels in fixed increments determined by how much each weight of the stack weighs. For example, if the pulley system allows for a 1 to 2 ratio and each plate in the stack weighs 20 pounds, the exerciser can change the resistance only in 10 pound increments. For an exerciser to increase the resistance by less than a full 10 pounds, for example by 5 pounds, he or she must add a "supplemental weight" to the stack. Previously used supplemental weights have taken the form of a small weight that is selectively removable from storage on a peg on the frame and is placed onto an aligned peg on the top plate of the weight stack. The separate supplemental weight design is counter to the advantages of using a simplified unitary stack for resistance. Furthermore, incorporating a separate supplemental weight can result in the supplemental weight being lost or removed from the exercise station, requiring the exerciser to break from his or her routine in order to utilize it. Additionally, much of the cost associated with exercise machines of this type is for the weights used for resistance. The additional purchase of the supplemental weights further increases the cost of the exercise machine. A second form of a supplemental weight is fixed small weights either on an arm or on a guide rod that provides a path to place the supplemental weight onto the main stack. These supplemental weights can be selectively engaged by sliding the supplemental weight onto the weight stack. This approach also requires the inclusion of additional, separate weight units, adding cost to the exercise machine.

Other exercise machines have been developed that allow for multiple weight ratios. Specifically, a pulley arrangement comprising two floating pulleys that allow for an exercise machine to contain multiple exercise stations having varying mechanical advantages. Devices of this type, however, require the use of different exercise stations to vary the weight ratio. This changing of the exercise stations does not provide the ability of the exerciser to choose a varied weight ratio while exercising at the same station.

SUMMARY OF THE INVENTION

The purpose and advantages of the invention will be set forth in and apparent from the description and drawings that follow, as well as will be learned by practice of the invention. Additional advantages of the invention will be realized and attained by the elements of the apparatus and method described.

To achieve these and other advantages and in accordance with the purpose of the present invention, as embodied and broadly described herein, a new and useful exercise machine is provided. In accordance with one aspect of the invention, the dual adjustable pulley system includes a frame, weight stack, pulleys, and cables. The weight stack is slidably connected to the frame. A primary moveable pulley system is functionally engaged with the weight stack by way of a primary cable. The primary cable has a handle, or other apparatus, connected to its first end and its second end is fixed with respect to an exercise movement. A series of directional pulleys are also engaged by the primary cable. The directional pulleys are positioned on the frame to allow for an exerciser to perform multiple exercises employing the weight stack. A secondary moveable pulley system is functionally connected with the primary moveable pulley system. The secondary moveable pulley system is selectively engaged with the weight stack using a releasable coupler. A secondary cable is functionally engaged with the secondary moveable pulley system and a number of directional pulleys. The secondary cable has a first end that is fixed to a floating pulley. The floating pulley is functionally engaged with the primary cable. The secondary cable has a second end that selectively engages the weight stack. The relationship between the primary moveable pulley system and the secondary moveable pulley system is such that when the handle is moved in an exercise motion, the weight stack provides resistance to the exercise motion.

In another aspect of the invention, the secondary moveable pulley system can be selectively engaged with the weight stack such that it allows the exerciser to select varying increments of weight to be lifted. The invention provides that when the secondary moveable pulley system is disengaged, the floating pulley will remain in a fixed vertical position and, as a result, the first moveable pulley system will provide a predetermined mechanical advantage to the exerciser lifting the selected number of weights from the weight stack. For example, in a pulley arrangement that provides a 1 to 4 mechanical advantage an addition of a 20 pound plate will effectively increase the load by 5 pounds.

According to the invention, if the secondary pulley arrangement is engaged, the mechanical advantage will be reduced. This decrease in mechanical advantage is achieved by engaging a releasable coupling to a bayonet which in turn causes the floating pulley to move down as the bayonet moves up. For example, if the first pulley arrangement provided a 1 to 4 mechanical advantage, the engagement of the secondary pulley arrangement would decrease the mechanical advantage to 1 to 2. Therefore, if an additional plate of 20 pounds was added to the stack it would effectively increase the load by 10 pounds.

It is to be understood that both the foregoing general description and the following detailed description are exemplary and provided for purposes of explanation only, and are not restrictive of the invention. In particular, while various aspects and advantages of the instant invention have been described above and will be described below, the invention is not limited thereto and other aspects and advantages, as will be apparent from the entirety of the present specification, exist.

DETAILED DESCRIPTION OF THE PREFERRED EMBODIMENTS

Figure 1:
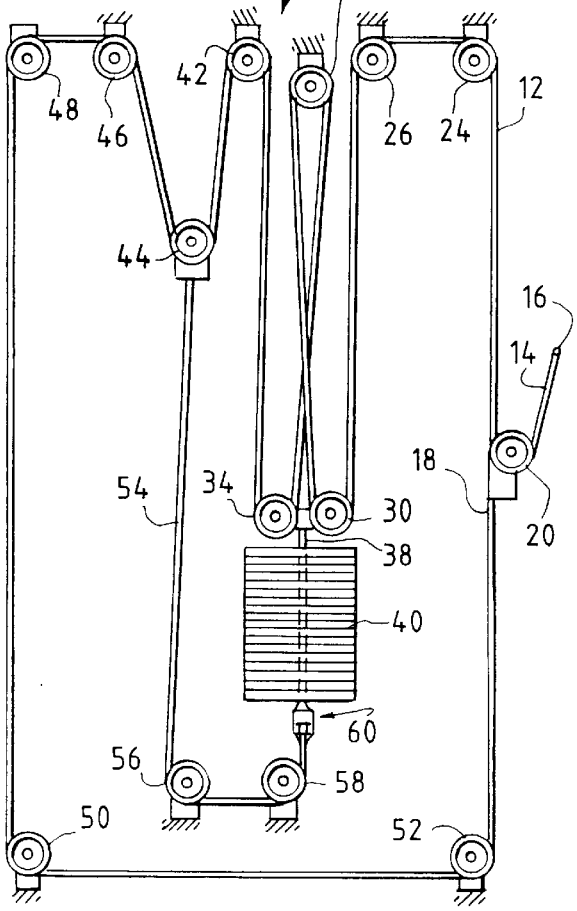
FIG. 1 is a schematic diagram of an embodiment of a dual adjustable pulley arrangement in accordance with the present invention.

While the invention can be embodied many different forms, there is shown in the drawings, and will herein be described in detail, preferred embodiments of the invention with the understanding that the present disclosure is to be considered as an exemplification of the principles of the invention and is not intended to limit the invention to the embodiments illustrated. The method of using the present invention will be described in conjunction with the detailed description of a dual adjustable pulley weight apparatus in accordance with the present invention.

Referring now to FIG. 1, a schematic representation of a dual adjustable pulley apparatus, which is designated generally by the reference character 10, is shown. In accordance with one aspect of the invention, the dual adjustable pulley apparatus 10 comprises a primary moveable pulley system, a secondary moveable pulley system and a number of directional pulleys, as described further below. A primary cable 12 is functionally engaged with the primary moveable pulley system, the secondary movable pulley system and the directional pulleys. The primary cable 12 is connected at a first end 14 to a handle 16, or other exercise apparatus, and at a second end 18 to a first directional pulley 20. Although FIG. 1 shows a handle 16, it will be understood that other apparatus can be substituted therefor. For example, a bar can be used to provide a gripping surface for both hands of the user. Alternatively, a cuff arrangement, closable by, for example, VELCRO, may be used to permit the user to exercise certain muscles when the cuff is attached to a wrist or an ankle. The primary cable 12 extends from the first directional pulley 20 to a fixed pair of directional pulleys 24 and 26.

Figure 2:
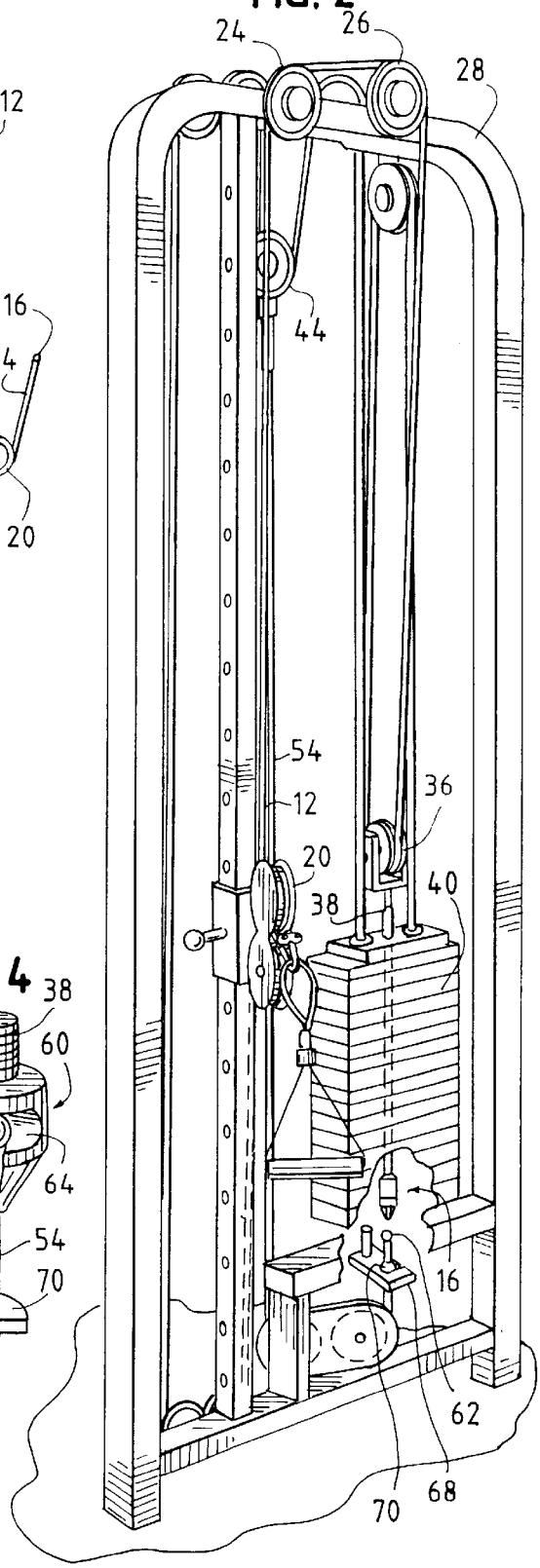
FIG. 2 is a front perspective view of an exercise machine employing a dual adjustable pulley arrangement in accordance with the present invention.

The primary cable 12 then extends to the primary moveable pulley system. The primary moveable pulley system comprises a first moveable pulley 30, a second moveable pulley 34 and a fixed pulley 32. While movable pulleys 30 and 34 are shown separately for purposes of illustration, in the preferred embodiment, pulleys 30 and 34 are disposed on the same axis, as is illustrated in FIG. 2. The primary cable 12 extends from the first moveable pulley 30 to the fixed pulley 32 and then to the second moveable pulley 34. The first and second moveable pulleys 30 and 34 are connected to a bayonet 38. As is conventionally known in the art, the bayonet 38 extends through a weight stack 40 having a number a weight plates and the user can select the number of plates to be lifted by inserting a pin (not shown) through the weight stack 40 into the bayonet 38. As a result, the bayonet 38 along with the number of weight plates from the weight stack 40 will move upwardly with pulleys 30 and 34 when the exerciser pulls on the handle 16, as described further below.

The primary cable 12 extends from pulley 34 to a fixed directional pulley 42. The primary cable 12 then extends to the secondary moveable pulley system, which is described in greater detail below. The primary cable 12 extends next to a second pair of fixed directional pulleys 46 and 48, and further to a third pair of fixed directional pulleys 50 and 52. The second end 18 of the primary cable 12 is finally connected to the first directional pulley 20.

The secondary moveable pulley system comprises a floating pulley 44, directional pulleys 56 and 58 and a secondary cable 54. The first end of the secondary cable 54 is connected to the floating pulley 44. The secondary cable 54 extends from the floating pulley 44 to the fixed pair of directional pulleys 56 and 58. The secondary cable 54 then is attached to a releasable coupler 60, which can be selectively engaged to the lower end of the bayonet 38.

Referring now to FIG. 2, with continued reference to FIG. 1, a front perspective view of an exercise machine employing a dual adjustable pulley arrangement is shown. FIG. 2 illustrates the frame, weight stack, and certain pulleys, without detailed illustration of supports and additional aspects that can be included in the machine, such as a bench or other exercise surface. Furthermore, an additional frame, weight stack and pulleys can be incorporated directly opposite the machine shown in FIG. 2, allowing for additional exercises to be performed. Those skilled in the art will readily understand how to incorporate the above in view of the disclosure made herein.

In accordance with one embodiment of the invention, the dual adjustable pulley apparatus comprises a frame 28 and the primary cable 12 that is connected at its first end 14 to the handle 16 and at its second end 18 connected to the first directional pulley 20. This directional pulley 20 is shown as a dual pulley, the height of which can be adjusted, as is described more fully with respect to FIG. 3. The primary cable 12 is functionally engaged with the primary moveable pulley system. The primary cable 12 extends from the first directional pulley 20 over a first pair directional of pulleys 24 and 26 that are connected to the upper portion of the frame 28.

The primary cable 12 next extends to the primary moveable pulley system. The primary moveable pulley system comprises a first moveable pulley 36 and a fixed pulley 32. The first moveable pulley 36 comprises two pulleys (shown in FIG. 1 as pulleys 30 and 34) in a block rotating around the same axis, and connected to a bayonet 38. The primary cable 12 is initially engaged with the first of the two pulleys within pulley 36. The primary cable 12 then extends up to pulley 32 that is fixed to the upper portion of the frame 28. The primary cable 12 extends back down to the pulley 36 and around the second pulley in the block. As is conventionally known in the art, the bayonet 38 extends through a weight stack 40 having a number a weight plates and the user can select the number of plates to be lifted by inserting a pin through the weight stack 40 into the bayonet 38. As a result, the bayonet 38 along with the selected number of weight plates from the weight stack 40 will move upwardly with pulleys 30 and 34 when the exerciser pulls on the handle 16.

The secondary cable 54 is connected at its first end to the floating pulley 44. The secondary cable 54 can be selectively engaged by use of a releasable coupler 60 to the lower end of the bayonet 38. The releasable coupler 60 comprises a ball 62 attached to a second end of the secondary cable 54. The ball 62 can be selectively engaged by the exerciser into a slot in a coupler secured to the lower end of the bayonet 38 by using a latching lever 68. The portion of the secondary cable 54 below the ball 62 includes a stop 70 that abuts the top surface of the latching lever 68 when the secondary cable 54 is disengaged from the coupler 66. The stop 70 performs the function of keeping the floating pulley 44 in one position when the secondary cable 54 is disengaged from the coupler 66.

Figure 3:
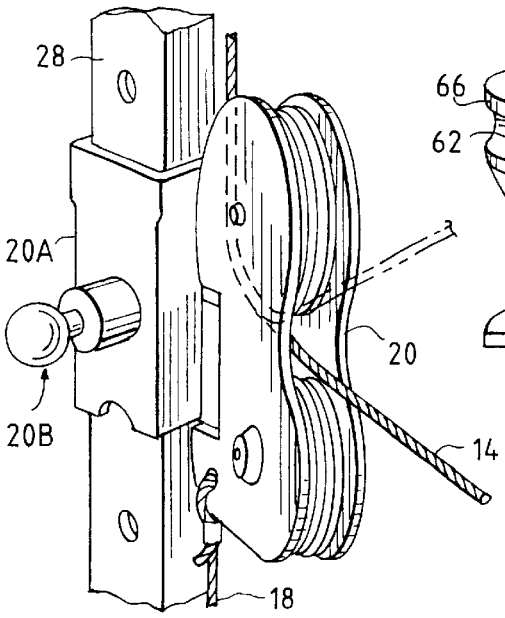
FIG. 3 is a partial perspective view of a first directional pulley in accordance with the present invention.

Referring now to FIG. 3, with continued reference to FIGS. 1 and 2, a partial perspective view of a first directional pulley 20 in accordance with an alternate embodiment of the present invention is shown. The first directional pulley 20 comprises two pulley wheels aligned to rotate in the same plane and a collar 20A that can be adjusted for height on a frame 28 by using a spring loaded pin 20B. A primary cable 12 is engaged with the first directional pulley 20 such that a first end 14 of the primary cable 12 extends from the pulley in a first direction and is connected to a handle and the second end 18 of the primary cable 12 extends from the pulley in a second direction to be engaged with additional pulleys and the weight stack as described above. Thus, by adjusting the height of the directional pulley 20, the exercises is able to perform any number of exercise movements using a variety of exercise apparatus, such as pulldown, arm curl, upright row, press exercises, etc.

Figure 4:
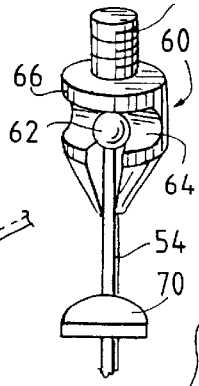
FIG. 4 is a partial perspective view of an embodiment of a releasable coupling device attached to a secondary moveable pulley system in accordance with the present invention.

Referring now to FIG. 4 with continued reference to FIGS. 1–3, a partial perspective view of a releasable coupling device attached to the secondary moveable pulley arrangement is shown. The releasable coupler comprises a ball 62 attached to a second end of the secondary cable 54 that can be selectively engaged by the exerciser into a slot 64 in a coupler 66 secured to the lower end of the bayonet 38 by using a latching lever 68. The portion of the secondary cable 54 below the ball 62 includes a stop 70 that abuts the top surface of the latching lever 68 when the secondary cable 54 is disengaged from the coupler 66. The stop 70 performs the function of keeping the floating pulley 44 in one position when the secondary cable 54 is disengaged from the coupler 68.

When the secondary moveable pulley system is disengaged the floating pulley 44 will remain in a fixed vertical position. When the exerciser pulls on the primary cable 12 the weight stack 40 will move up in the vertical direction. The floating pulley 44 will remain in a relatively fixed vertical position because the stop 70 will abut the top surface of the latching lever 68. The first moveable pulley system provides a predetermined mechanical advantage to the exerciser lifting the selected number of weights from the weight stack.

If the secondary moveable pulley system is engaged the mechanical advantage will be reduced. This decrease in mechanical advantage is achieved by engaging the ball 62 at the second end of the secondary cable 54 into the slot 64 in the coupler 66. The coupling of the secondary cable 54 to the bayonet 38 engages the secondary moveable pulley system such that the floating pulley 44 moves down as the bayonet 38 moves up. For example, if the first pulley arrangement provides a 1 to 4 mechanical advantage the engagement of the second pulley arrangement would decrease the mechanical advantage to 1 to 2. Therefore, if an additional plate of 20 pounds was added to the stack it would effectively increase the load by 10 pounds.

Other embodiments of the invention will be apparent to those skilled in the art from consideration of the specification and practice of the invention disclosed herein.

It is intended that the specifications and examples be considered as exemplary only, with the true scope and spirit of the invention being indicated by the following claims.

What is claimed is:

1. An exercise machine comprising:

a frame;

a weight stack slidably connected to the frame;

a primary moveable pulley system engaged with the weight stack comprising:

a primary cable having a first end and a second end, wherein the first end is moveable in response to an exercise motion, and the second end is fixed with respect to the first end; and one or more directional pulleys;

a secondary moveable pulley system selectively engaged with the weight stack comprising:

a floating pulley; and a secondary cable having a first end connected to the floating pulley and a second end selectively engaged with the weight stack;

wherein the primary cable is functionally engaged with the one or more directional pulleys and the floating pulley such that when the first end of the primary cable is moved in the exercise motion, the weight stack provides resistance to the exercise motion; and wherein selective engagement of the secondary moveable pulley system with the weight stack changes the mechanical advantage of the primary moveable pulley system.

2. The machine as claimed in claim 1, wherein a first directional pulley has a collar that can be adjusted for height on the frame using a spring loaded pin.

3. The machine as claimed in claim 2, wherein the first directional pulley comprises two pulley wheels rotating in the same plane.

4. The machine as claimed in claim 1, wherein the primary moveable pulley system engages the weight stack with a bayonet that extends through the weight stack and the weight stack has a number of weight plates that can be engaged by inserting a pin through the weight stack into the bayonet.

5. The machine as claimed in claim 4, wherein a lower end of the bayonet includes a slot and a coupler.

6. The machine as claimed in claim 1, wherein the secondary cable can be selectively engaged with the weight stack using a releasable coupling comprising:

a ball connected to the end of the second cable;

a slot in the coupling into which the ball can be selectively engaged; and a latching lever wherein the coupling is connected to the lower end of the bayonet by engaging the latching lever.

7. The machine as claimed in claim 6, wherein the secondary cable includes a stop below the ball, wherein the stop abuts a top portion of the latching lever when the second cable is not engaged with the coupler.

8. An exercise machine comprising:

a frame;

a weight stack slidably connected to the frame;

a primary moveable pulley system engaged with a weight stack comprising:

a primary cable; having a first end a first directional pulley;

a plurality of fixed primary directional pulleys secured to the frame; and at least two moveable pulleys secured to the weight stack;

a secondary moveable pulley system selectively engaged with a weight stack comprising:

a floating pulley;

a secondary cable with a first end connected to the floating pulley;

a plurality of fixed secondary directional pulleys connected to the frame; and a releasable coupling between a second end of the secondary cable and the weight stack;

wherein the primary cable is functionally engaged with the first directional pulley, the plurality of primary directional pulleys, and the floating pulley such that when the first end of the primary cable is moved in an exercise motion, the weight stack provides resistance to the exercise motion; and the secondary cable is functionally engaged with the secondary directional pulleys and can be selectively engaged with the weight stack.

9. The machine as claimed in claim 8, wherein the first directional pulley includes a collar that can be adjusted for height on the frame using a spring loaded pin.

10. The machine as claimed in claim 9, wherein the first directional pulley comprises two pulley wheels rotating in the same plane.

11. The machine as claimed in claim 8, wherein the primary moveable pulley system engages the weight stack with a bayonet that extends through the weight stack and the weight stack has a number of weight plates that can be engaged by inserting a pin through the weight stack into the bayonet.

12. The machine as claimed in claim 11, wherein a lower end of the bayonet includes a slot and a coupler.

13. The machine as claimed in claim 12, wherein the secondary cable can be selectively engaged with the weight stack using a releasable coupling comprising:

a ball connected to the end of the second cable wherein the ball can be selectively engaged with the slot; and a latching lever wherein the coupler is connected to the lower end of the bayonet by engaging the latching lever.

14. The machine as claimed in claim 13, wherein the secondary cable includes a stop below the ball, wherein the stop abuts a top portion of the latching lever when the second cable is not engaged with the coupler.

15. An exercise machine comprising:

a frame having an upper and a lower portion;

a weight stack slidably connected to the frame;

a primary moveable pulley system engaged with the weight stack comprising:

a primary cable having a first end connected to a handle and a second end connected to a first directional pulley;

one or more directional pulleys secured to the upper portion of the frame;

a fixed pulley secured to the upper portion of the frame;

a first and second moveable pulley connected to a bayonet; and one or more directional pulleys secured to the lower portion of the frame;

a secondary moveable pulley system selectively engaged with the weight stack comprising:

a floating pulley;

a secondary cable with a first end connected to the floating pulley;

one or more secondary directional pulleys secured to the lower portion of the frame; and a releasable coupling situated between a second end of the secondary cable and the weight stack;

wherein the primary cable extends in a path which engages the first directional pulley, the one or more directional pulleys secured to the upper frame, the first moveable pulley, the fixed pulley, the second moveable pulley, the floating pulley, the one or more directional pulleys secured to the lower frame, and finally end of the primary cable is fixed to the first directional pulley;

the secondary cable extends in a path which extends from the floating pulley to engage the one or more secondary directional pulleys secured to the lower frame and the secondary pulley is releasably coupled with the weight stack and wherein selective engagement of the secondary moveable pulley system with the weight stack changes the mechanical advantage of the primary moveable pulley system.

16. The machine as claimed in claim 15, wherein the first directional pulley has a collar that can be adjusted for height on the frame using a spring loaded pin.

17. The machine as claimed in claim 16, wherein the first directional pulley comprises two pulley wheels rotating in the same plane.

18. The machine as claimed in claim 15, wherein the primary moveable pulley system engages the weight stack with a bayonet that extends through the weight stack and the weight stack has a number of weight plates that can be engaged by inserting a pin through the weight stack into the bayonet.

19. The machine as claimed in claim 18, wherein the lower end of the bayonet includes a slot and a coupler.

20. The machine as claimed in claim 19, wherein the secondary cable can be selectively engaged with the weight stack using a releasable coupling comprising:

a ball connected to the end of the second cable wherein the ball can be selectively engaged with the slot; and a latching lever wherein the coupler is connected to the lower end of the bayonet by engaging the latching lever.

* * * * *